US007819306B2

(12) United States Patent
Williams et al.

(10) Patent No.: US 7,819,306 B2
(45) Date of Patent: Oct. 26, 2010

(54) BANKNOTE TRANSPORTER

(76) Inventors: Richard N Williams, Woodlands, London Road East, Amersham, Buckinghamshire (GB) HP7 9OH; Stuart P Sykes, 6 Hewitt Avenuo, Caversham, Roading (GB) RC4 7EA; Paul C L Richards, Quill Cottage, 6 Coopers Rd, Little Heath, Potters Bar Herts (GB) FN6 1JO ( * ) Notice: Subject to any disclaimer, the term of this patent is extended or adjusted under 35 U.S.C. 154(b) by 591 days.

(21) Appl. No.: 11/794,662

(22) PCT Filed: Jan. 3, 2006

(86) PCT No.: PCT/GB2006/000016

§ 371 (c)(1),
(2), (4) Date: Jul. 3, 2007

(87) PCT Pub. No.: WO2006/072781

PCT Pub. Date: Jul. 13, 2006

(65) Prior Publication Data

US 2008/0223915 A1 Sep. 18, 2008

(30) Foreign Application Priority Data

Jan. 5, 2005 (GB) ..... 0500068.2

(51) Int. Cl.
*A45C 1/12* (2006.01)

(52) U.S. Cl. ..... 232/1 D; 232/16; 194/350; 220/345.2

(58) Field of Classification Search ..... 232/1 D, 232/15, 16, 43.2; 194/350, 351, 206; 206/1.5, 206/807; 109/47; 220/345.2, 345.3, 345.4
See application file for complete search history.

(56) References Cited

U.S. PATENT DOCUMENTS

| | | | | | |
|---|---|---|---|---|---|
| 4,126,224 | A | | 11/1978 | Laawe et al. | |
| 4,283,097 | A | * | 8/1981 | Lundblad | 109/52 |
| 4,570,548 | A | * | 2/1986 | Martin et al. | 109/66 |
| 4,798,316 | A | * | 1/1989 | Martin et al. | 232/43.1 |
| 5,161,736 | A | * | 11/1992 | Roccoberton et al. | 232/15 |
| 5,533,605 | A | * | 7/1996 | Mays et al. | 194/206 |
| 5,850,966 | A | * | 12/1998 | Siler et al. | 232/15 |
| 5,890,439 | A | * | 4/1999 | McGunn | 109/47 |
| 2006/0071412 | A1 | * | 4/2006 | Lewis | 271/213 |

FOREIGN PATENT DOCUMENTS

| | | | | |
|---|---|---|---|---|
| DE | 3247308 | A | * | 5/1984 |
| EP | 1 503 351 | A2 | | 2/2005 |
| GB | 2 351 277 | A | | 12/2000 |
| WO | WO 02/19289 | A | | 3/2002 |

OTHER PUBLICATIONS

International Search Report for PCT/GB2006/000016 mailed Apr. 24, 2006.

* cited by examiner

*Primary Examiner*—William L. Miller
(74) *Attorney, Agent, or Firm*—Nixon & Vanderhye PC

(57) ABSTRACT

A banknote transporter includes a carrier and a lid. The carrier is adapted to receive bank notes and has side channels into which the lid can be slid to prevent access to the bank notes in the carrier. The side channels of the carrier engage with side portions of the lid, at least a component of the engagement providing resistance to or permanent indication of flexure or relative separation of the lid and carrier in the vertical direction.

4 Claims, 11 Drawing Sheets

BANKNOTE TRANSPORTER

This application is the U.S. national phase of International Application No. PCT/GB2006/000016 filed 03 Jan. 2006 which designated the U.S. and claims priority to GB 0500068.2 filed 5 Jan. 2005, the entire contents of each of which are hereby incorporated by reference.

BACKGROUND

1. Technical Field

This invention relates to apparatus for transportation of banknotes in tamper-proof carriers.

2. Related Art

It is known to provide portable banknote carriers into which notes can be inserted but not subsequently withdrawn without leaving evidence that there has been tampering. Carriers of this type are commonly used at tills where, for security, cashiers can insert banknotes when the stack of notes in a till exceeds a particular level, then at periodic intervals or the end of the day the carriers are locked, removed from their location at the till, marked with the till identification and handed over for counting and banking.

With such a system it is not necessary for the cashier to count the money put into the carrier because it will be evident if there had been tampering after the carrier has left the till. Nowadays it is often preferred for the carriers to be counted at an 'out of house' central accounting location or bank that may be remote from the original cashier's location. The carrier may be handled by individuals from different organisations such as security transportation firms. Thus, as well as requiring resistance to tampering, the carrier and its lid are preferably lightweight and recyclable, due to the cost and inconvenience of returning carriers.

Published European Patent Application EP-1314144-A describes one such system, in which a carrier is locked in place in a support structure for receipt of banknotes and when it is required to remove the carrier this can only be done after a tamper-proof lid has been inserted over the carrier. The mechanism is designed so that during the procedure of attaching the lid and subsequent removal of the carrier from the supporting structure it is not possible to remove notes. The lid slides over the carrier in one direction only and there are end stops that lock when the lid is fully engaged, and at that point release from the support structure is enabled. Access to the carrier requires breakage of the end stops so that the lid can be slid, in the same single direction, off the carrier at the opposite end from which it was introduced.

It has been found that the channels of the lid and carrier top, when made thin or of some plastics materials, have sufficient flexibility for them to be prized apart and notes removed without leaving evidence of tampering. It is desirable to make sure this cannot happen without having to make the relevant parts of thicker or different materials. Indeed it is preferable to be able to make the parts thinner in some instances, or of more easily recyclable materials.

BRIEF SUMMARY

The present invention is directed towards providing an improved tamper proof carrier and lid. It is further concerned with providing an alternative note removal system.

According to an exemplary embodiment, there is provided apparatus for the storage and transport of bank notes comprising a carrier and lid, the carrier being adapted to receive bank notes and having side portions into which the lid can be slid to prevent access to the bank notes in the carrier, the side portions of the carrier having means for engaging with side portions of the lid, characterized in that the means for engaging provides resistance to or permanent indication of flexure or relative separation of the lid and carrier in the vertical (as herein defined) direction.

In one embodiment, engagement is preferably effected by way of a series of flanges or latches that extend vertically from at least one set of confronting surfaces of the lid and channel.

In another embodiment, the side portions each comprise a channel having a substantially closed section and the side portions of said lid each comprise an engagement portion extending within said channel.

In such an embodiment each channel may comprise an outer side wall, a top wall, an inner side wall depending from the top wall and a flange extending laterally from a bottom of the inner side wall and spaced from said base and the side portions of said lid may each comprise an engagement portion extending within said channel for accommodation between said top wall and said lateral flange.

Preferably the lid comprises at a forward end a tongue which has serrate parts facing in said vertical direction and positioned to engage corresponding parts of the carrier to prevent withdrawal of the lid from the carrier.

BRIEF DESCRIPTION OF THE DRAWINGS

The invention will now be described by way of example with reference to the accompanying drawings in which.

DETAILED DESCRIPTION OF EXEMPLARY EMBODIMENTS

Figure 1:
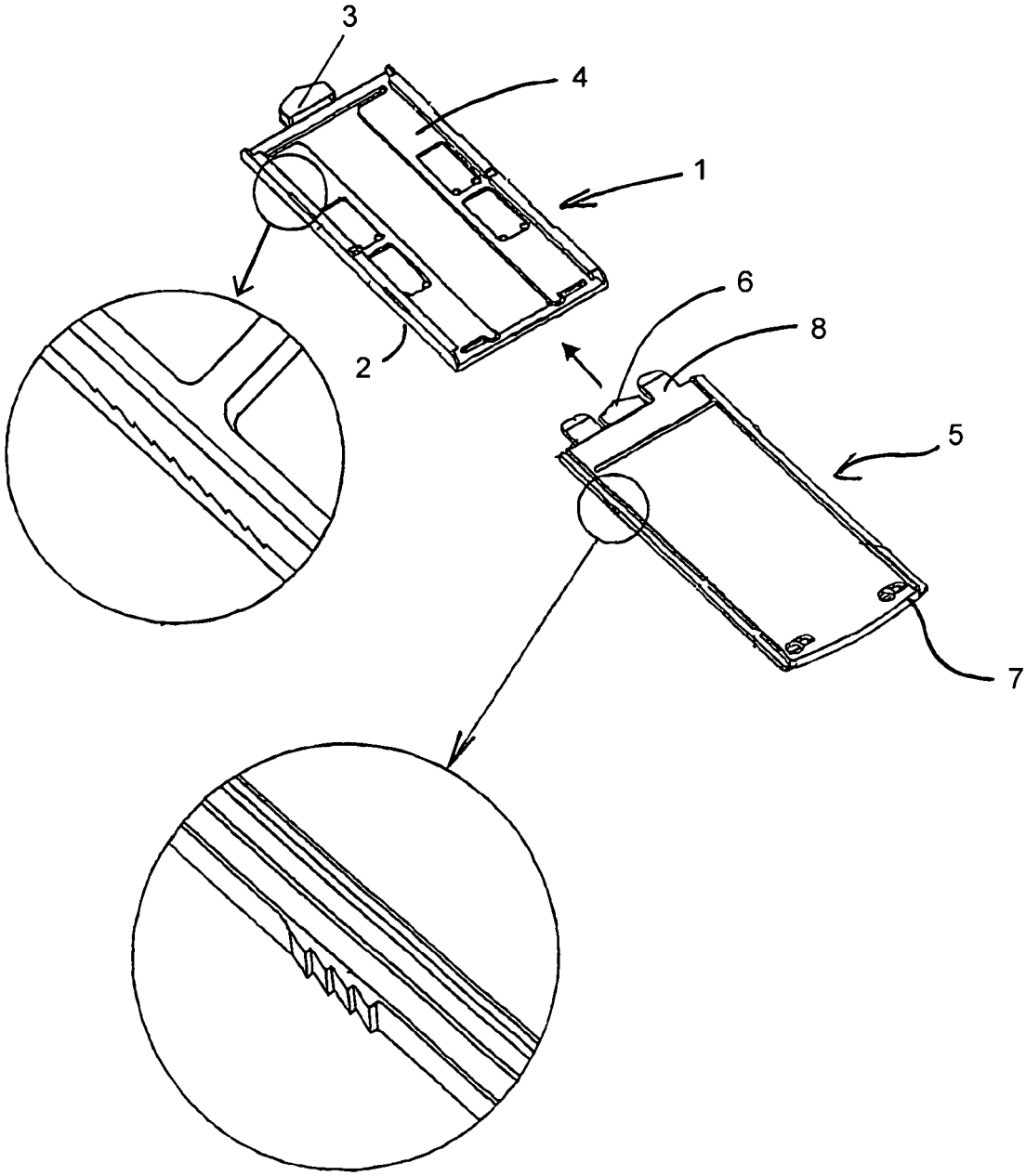
Figure 1 (Prior Art)
FIG. 1 shows a prior art carrier and lid assembly.

Referring to FIG. 1, this shows a carrier and lid of the general type described in EP-1314144-A. The carrier 1 is generally in the form of a shallow cassette or box consists of a frame having side channels 2 and a hollow end tab 3. On the underside of the carrier, as viewed, an elastic sheet of material is attached to each side of the frame to form an expandable pouch or bag. Flaps 4 extend from the side channels and can be flexed down as notes are inserted into the carrier from above, as viewed. In use the carrier is mounted in a support structure and cannot be removed from the support structure until a lid 5 is slid into the side channels of the carrier and fully engaged over the carrier, with a tab 6 engaging within hollow tab 3 and end hooks 7 engaging under the opposite end of the carrier. Simultaneously with such engagement projections 8 operate a mechanism to release the carrier from the support structure.

The lid can only be moved in the direction of the arrow because the side channels of the carrier aid the sides of the lid are provided with laterally engaging opposed saw tooth projections which prevent reverse movement. To open the carrier once the lid is in place, the combined tabs 3 and 6 are bent down to fracture the tab and the hooks 7 are also fractured, then the lid can be slid off the carrier at the tab end. With this arrangement, the tab 6 can be removed from the hollow tab 3 and the carrier reused. The lid is only single use, because the tab and hooks have been fractured and this is what provides evidence of tampering. Lids are marked with details of the till and cashier and are therefore difficult to substitute as part of a theft operation.

With this system, if the material of the carrier and lid are sufficiently flexible it has been found that the channel parts can be flexed apart, notes fished out and then the lid and carrier allowed to return to their inflexed state. This can happen even with the saw tooth engagement in the channels as this only prevents backward movement in the same plane as the lid and carrier frame, whereas the flexing to remove notes is in the direction out of the plane of the lid. This direction is referred to herein as the 'vertical' direction, as if the lid is in the horizontal plane, but these are relative orientations, vertical meaning within the context of this specification out of or normal to the plane of the lid or plane of the top of the carrier.

The invention provides a locking mechanism in the channel and lid engagement that prevents this 'vertical' flexing by having at least a part or component of the engagement in the vertical direction. In one embodiment now described the proper access to the carrier is via removal of the lid, as in the prior art. In an alternative described later, the lid remains permanently fixed in position and access is via the bag.

Figure 2:
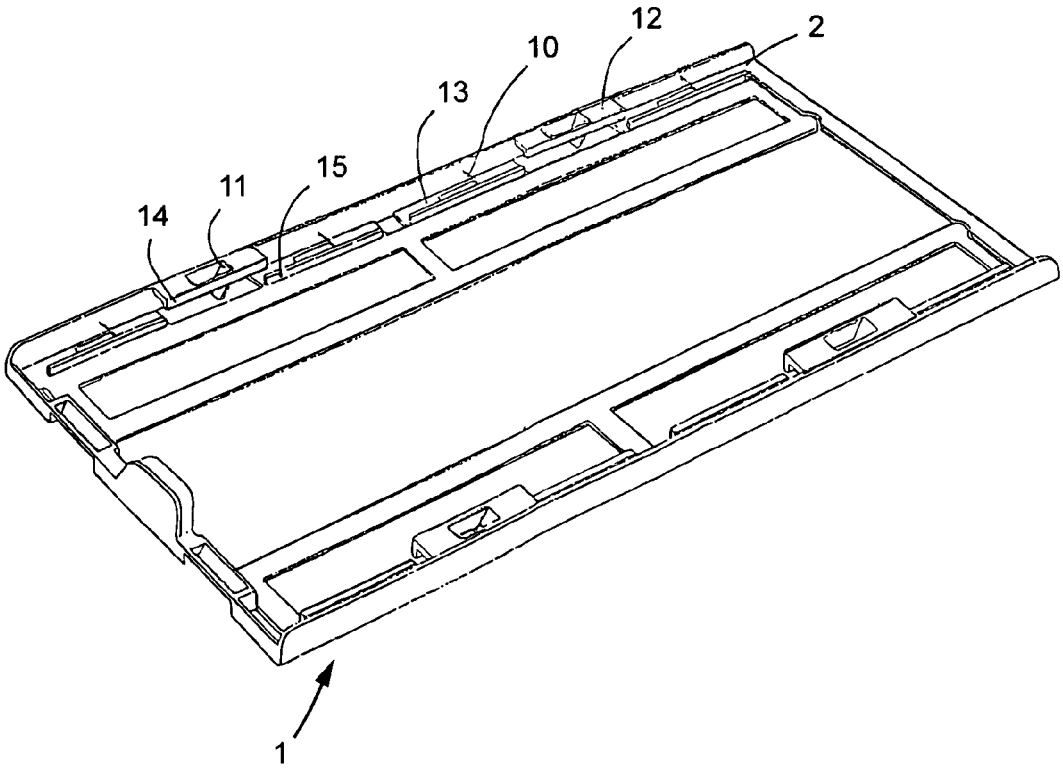
FIG. 2 shows a perspective view of a carrier top of a preferred embodiment of the invention.
Figure 3:
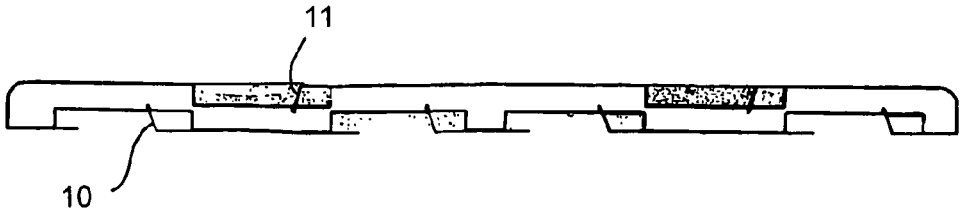
FIG. 3 shows a longitudinal cross sectional view through a side channel of a carrier top of FIG. 2.

Referring now to FIGS. 2 and 3, the carrier frame 1 is shown modified in accordance with a preferred embodiment of the invention. FIG. 2 is a perspective view and FIG. 3 is a longitudinal cross section along one of the side channels 2. The side channels 2 of the carrier are provided with a series of upwardly and downwardly (assuming a horizontal orientation for the carrier frame) angled flanges 10 (upward) and 11 (downward). The flanges 10 and 11 are arranged to flex sufficiently to allow a flange or protrusion on the lid to pass over in the direction from the right as viewed, in this particular arrangement that corresponding to movement in the direction from the fixed end of the flange on the lower or upper surface of the channel toward the free end of the flange that protrudes into the channel space. As shown in this embodiment, the upper and lower surfaces of the channel 12,13 are intermittent rather than continuous. This is for economy of material and in other embodiments they may be continuous.

It will also be noted that the inner sides of the channel have lips 14,15, extending from the respective upper surface 12 and lower surface 13 of the channel. The vertical spacing between these lips corresponds to the thickness of the lid. Again, if the upper and lower surface is continuous rather than intermittent, these lips may also (but not essentially) be continuous or may extend from just one of the upper and lower surfaces.

Figure 4:
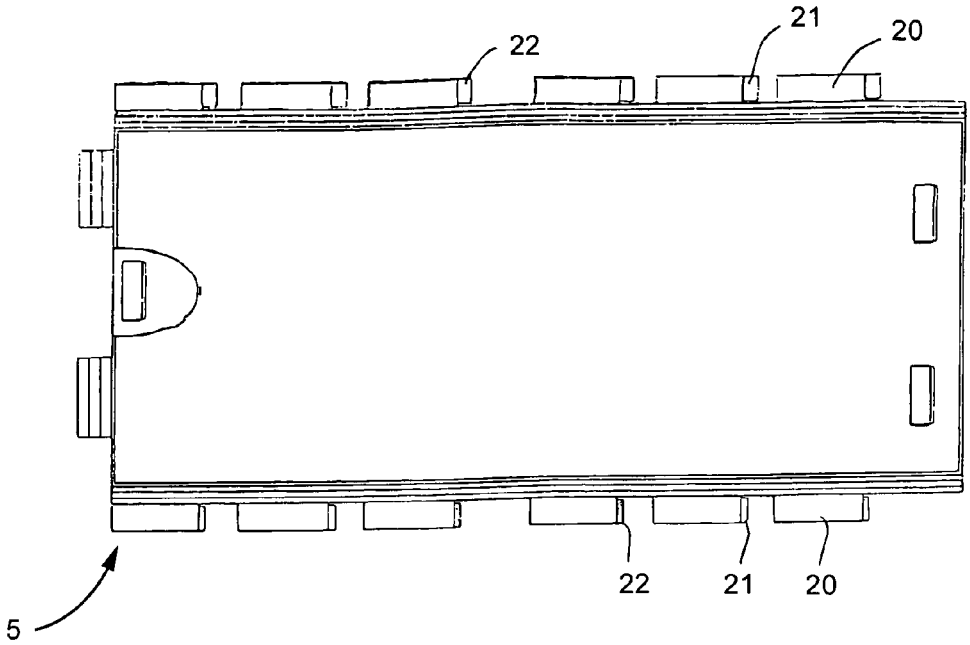
FIG. 4 shows a plan view from above of a lid according to one embodiment of the present invention.
Figure 5:
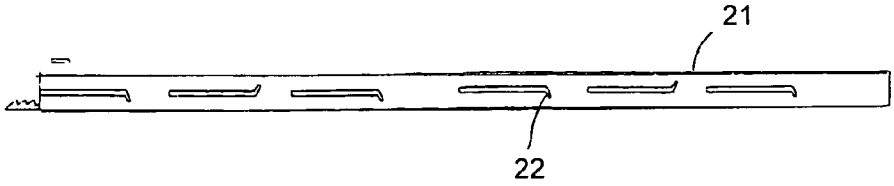
FIG. 5 shows a longitudinal cross sectional view through a side channel of the lid of FIG. 4.
Figure 6:
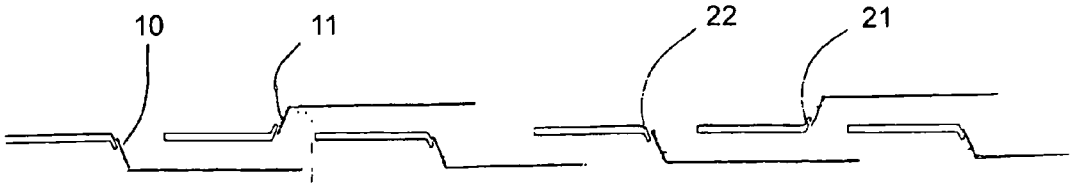
FIG. 6 shows a longitudinal cross section through a side channel with lid engaged.

FIGS. 4 and 5 show a lid modified to correspond with the channel of FIGS. 2 and 3. Each long side of lid 5 has a series of edge portions 20 each of which is provided with either an upwardly 21 or downwardly 22 directed flange. As with the carrier channels, the edge portions could be constructed to be continuous rather than as separate portions. The lid is inserted into the channels of the carrier from the right hand end of the carrier as viewed and in each channel the series of forwardly (with regard to the direction of travel of the lid) inclined flanges is encountered by the series of rearwardly inclined flanges of the lid. The flanges flex sufficiently to allow forward travel of the lid, but rearward travel is prevented or breaks the flanges. Once the lid is fully engaged on the carrier the flanges of the lid and channels overlap as shown in FIG. 6. It will be appreciated that the arrangement of the flanges could be reversed so that instead of the lid having flanges with free leading edges (with regard to the direction of movement for inserting the lid), these could be provided on the channels and the lid could have flanges with free leading edges, as shown in the drawings for the channel.

Depending on the strength and flexibility of the hinges where the flanges are connected, the overlapping configuration of the flanges when the lid is engaged provides resistance in the vertical direction when the hinges resist 'closing' movement. In general the behaviour of the flanges is asymmetric in that they flex more easily to open the obtuse angle further, but resist reduction of that angle or break. If attempts to flex the lid and carrier are made, in some embodiments the resistance is just too great, or the flanges break, thereby giving an indication of tampering. If the flanges do flex sufficiently to allow the flanges to disengage, they will not return to the engaged position. Modification to the free ends of the flanges may be incorporated, for example to provide curved portions that form interengaging hooks providing additional resistance to vertical separation. Flanges may alternatively be provided in the form of sawtooth formations providing that the teeth have sufficient overlap to resist prizing apart.

Modifications to the arrangement shown are possible, in particular the flanges on the lid may be replaced by solid protrusions. This may be preferred when a more robust lid structure is required, for example if there is risk of the flanges being broken by handling or storage before being locked on the carrier. There is less risk of this happening with the flanges of the carrier as these are protected by the channel, especially if the upper and lower surfaces are made continuous. In some embodiments interconnecting flanges may be provided on only one surface of the lid and channel, for example on the lower surface of the lid and the lower surface of the channel which are the ones that would need to be prized apart to access the notes.

In a further modification a sawtooth engagement may also be incorporated into the structure either in the channels, or the tab. In another modification the tab structure may be combined with the protrusions and the separate tab eliminated. The combined tab protrusions may also have sawtooth engagement as a mechanism to prevent rearward flexing along that edge. Further, instead of using an elastic material for the bag, this may be replaced by a non-elastic bag, for example a polypropylene bag may conveniently be attached by means such as sonic welding to the carrier, which is better for recycling purposes. A loose or semi-rigid concertina bag may also be used.

Materials other than plastics may also be used. Metal components are possible, but in general are too expensive. Assemblies made of or including paper products or composites are possible, a completely paper or card based product being particularly preferred. All that is required is for the structure to show evidence of tampering but be sufficiently robust to withstand normal handling. The bag may be formed of paper and be loose, folded or concertinaed.

In further embodiments of the invention the lid may be permanently fixed in the channels. This may be achieved for example by replacing the flanges with apertures and latches or cooperating latches. To enable the lid to slide on the carrier the apertures and latches may be staggered or of different shapes or sizes so that the latches only engage in their respective apertures when the lid is fully engaged. It is still a feature of this arrangement that there is a vertical component to the fixing so that the lid and channel can not be flexed apart without leaving evidence. With the permanently fixed lid, access to the notes in the carrier is by way of opening the bag in a way that includes at least partial destruction such as a tear. In the simplest arrangement the bag is cut, and for this purpose a polypropylene bag is useful. In order to eliminate the need for instruments to cut the bag, lines of weakness may be provided.

FIGS. 7 to 14 illustrate an embodiment in which the resistance to flexing is provided by the shaping of the side portions of the carrier and the lid.

Figure 7:
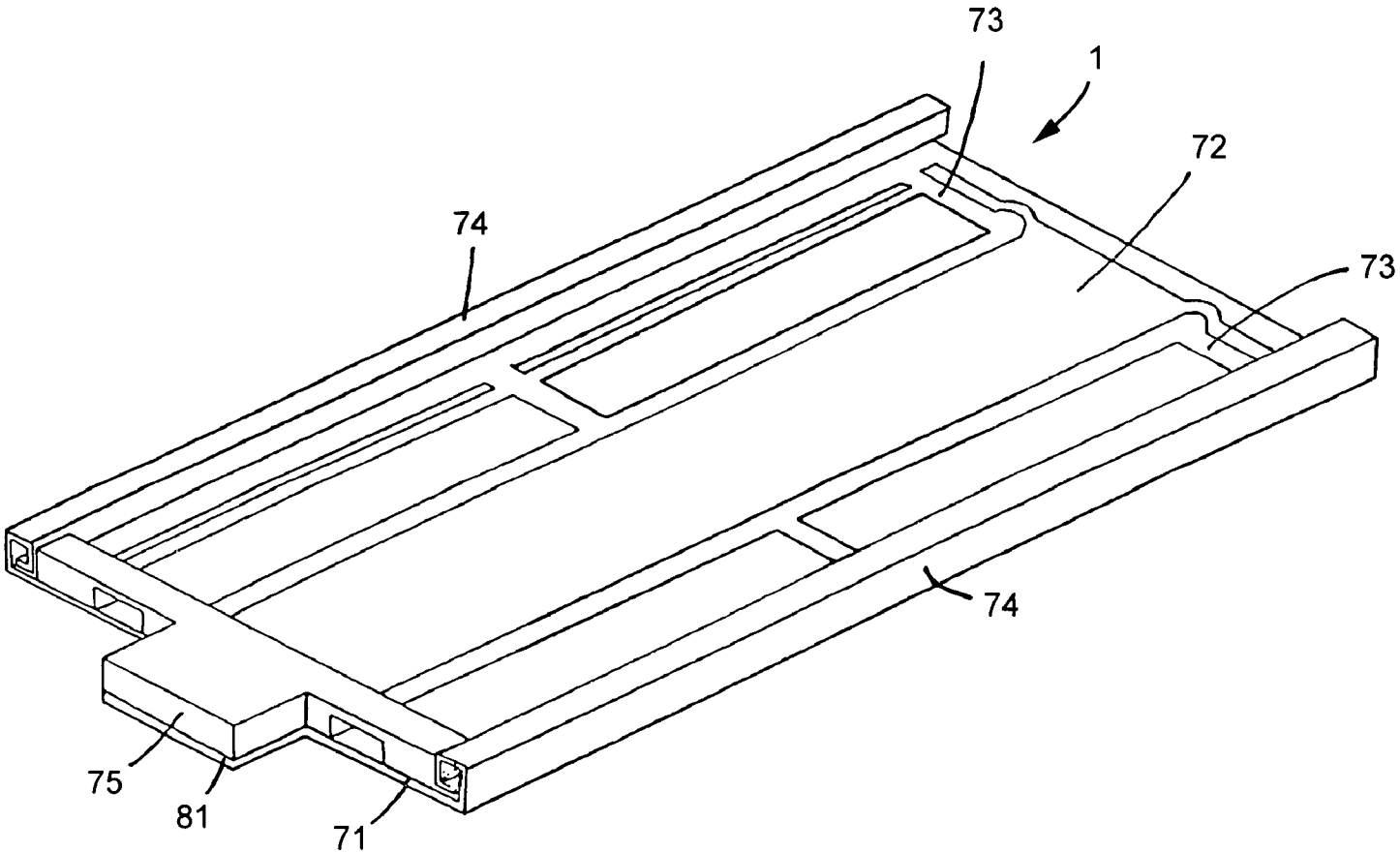
FIG. 7 is a perspective view of a carrier according to a second embodiment of the invention.

FIG. 7 is a perspective view of a carrier 1 according to this embodiment. It comprises a flat base 71 which has a large central longitudinal aperture 72 and two side flaps 73 and 74, which are apertured to reduce material and to make them more flexible. At each side margin of the base is a respective one of two box-section longitudinal channels 74 to be further described with reference to FIG. 1. The channels fully embrace the corresponding side portions of the lid (shown in FIGS. 9 and 10). At the forward end of the carrier is an insert 75 which spans the carrier between the leading ends of the channels 74.

Figure 8:
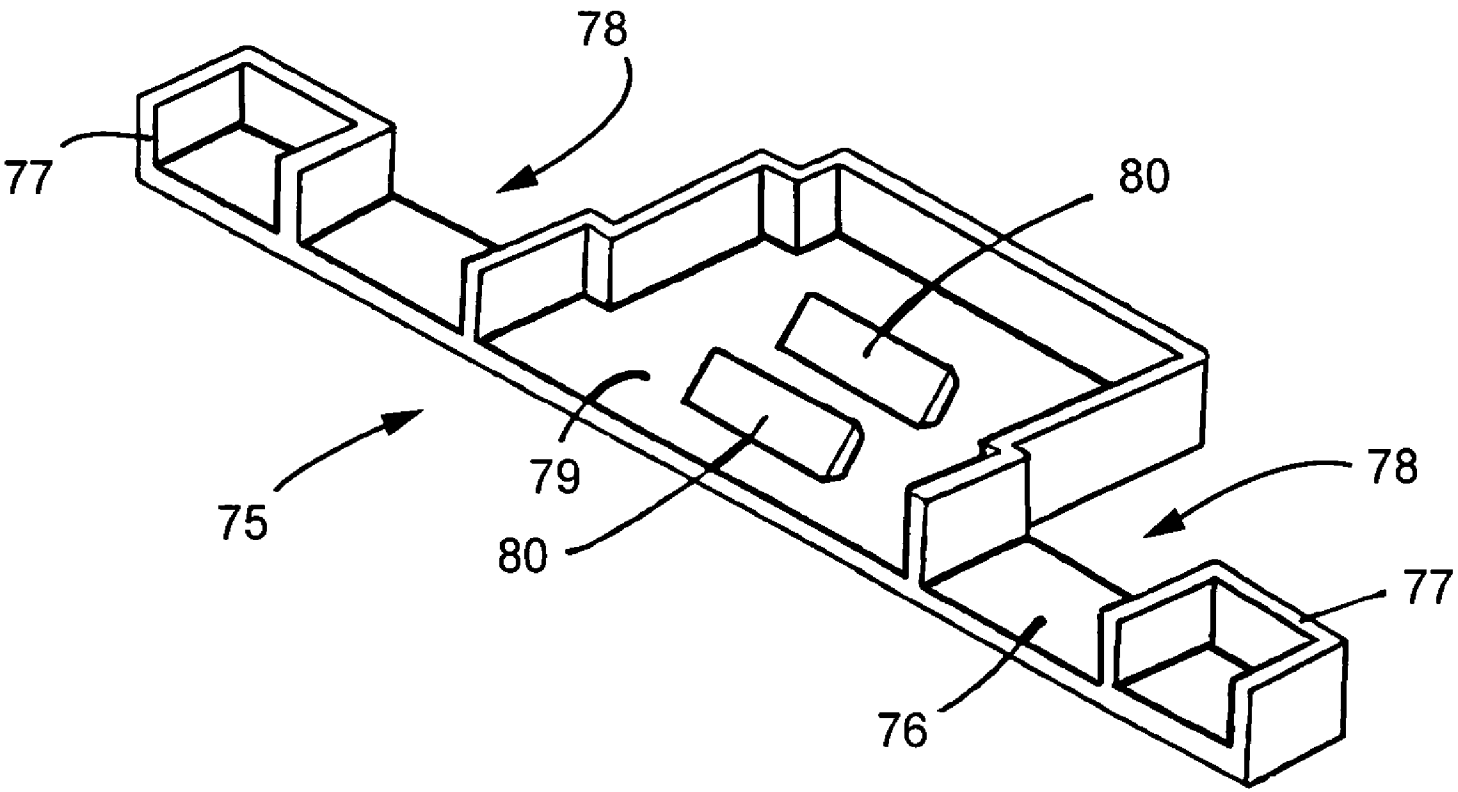
FIG. 8 is a perspective view of part of the carrier shown in FIG. 7.

FIG. 8 shows the insert 75, which comprises an elongate plate 76 having integral therewith an open box section 77 at each end, partly to add strength, partly to receive forward projections of the lid and partly to define a respective aperture 78 with a central open box section 79. Within the central box section 79 are disposed on the plate 76 are raised serrations 80 which face substantially in the 'vertical' direction. The central box section fits over a correspondingly sized and shaped front tab 81 (FIG. 7) extending forwardly from the base 71 of the carrier 1.

Figure 9:
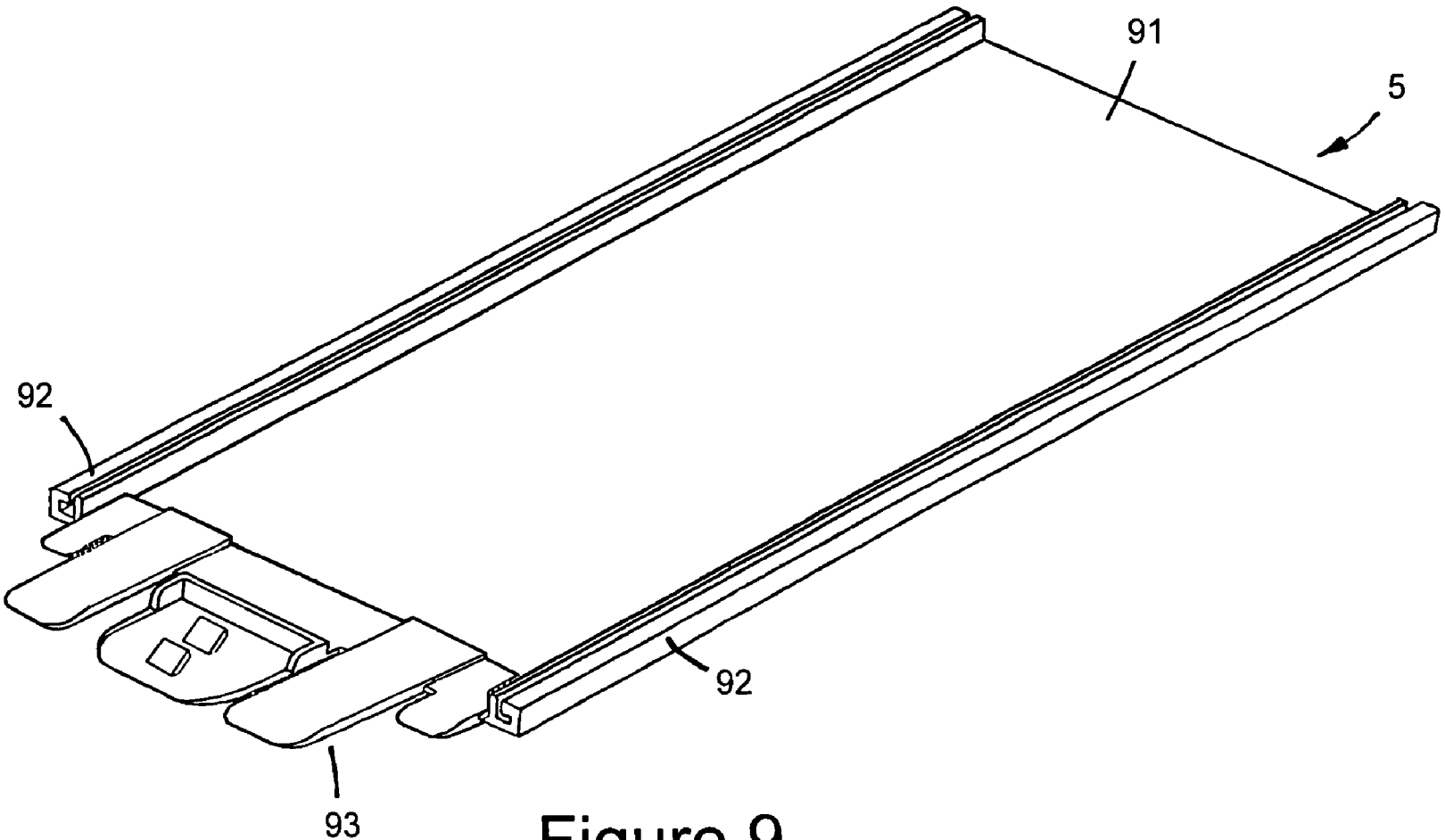
FIG. 9 is a perspective view of a lid for use with the carrier shown in FIGS. 7 and 8.

FIG. 9 illustrates a lid 5 for use with the carrier 1 shown in FIGS. 7 and 8. It comprises a generally flat plat 91 and two longitudinal side portions 92 which fit slidingly into the channels 74 of the carrier 1. At its front end the lid comprises an insert 93.

Figure 10:
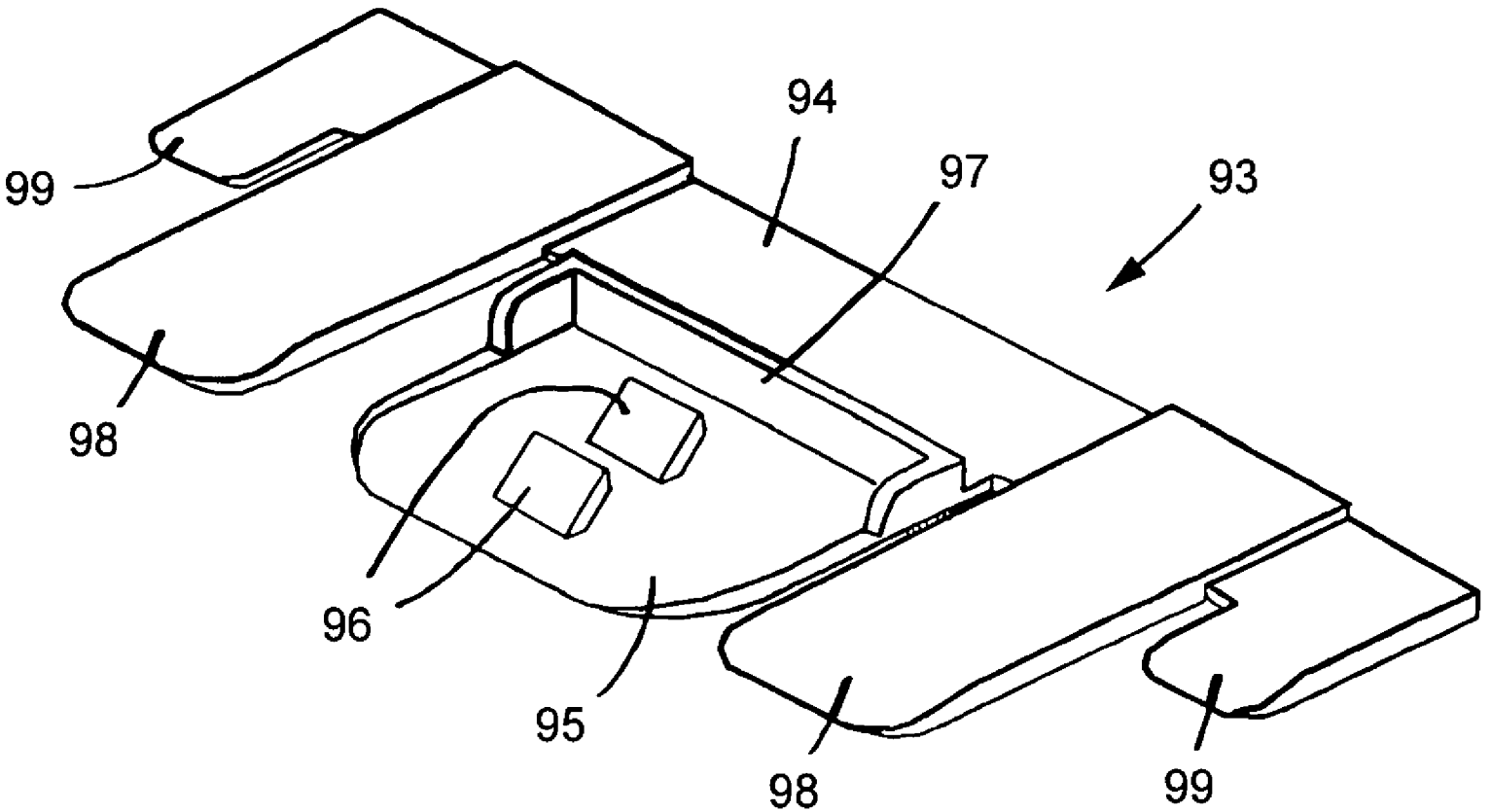
FIG. 10 is a perspective view of part of the lid shown in FIG. 9.

As is shown in FIG. 10, the insert 93, comprises an elongate plate 94 from which extends forwardly a tongue 95. This tongue is adapted to fit within the central box section 79 of the carrier 1. The tongue includes serrate projections 96 which are positioned and adapted to engage the serrations 80 unidirectionally such that once engagement is achieved the respective parts must be broken to allow separation of the lid and carrier. Across the tongue and behind the serrate projections 96 is a barrier wall 97 which closes the mouth of the central box section 79 when the lid is fully inserted into the carrier.

At each side of the tongue 95 is a respective one of two projections 98, which when the lid is inserted fully into the carrier extend through the apertures 78 between the section 79 and the sections 77 of the carrier. These projections 98 may thereby allow release of the carrier form the mechanism previously described. At each end of the insert 93 is another one of two projections 99 each of which is received by a respective side box section 77 of the lid 1.

Each of the inserts 75 and 93 may be secured within the carrier and lid respectively by adhesive or heat treatment.

Figure 11:
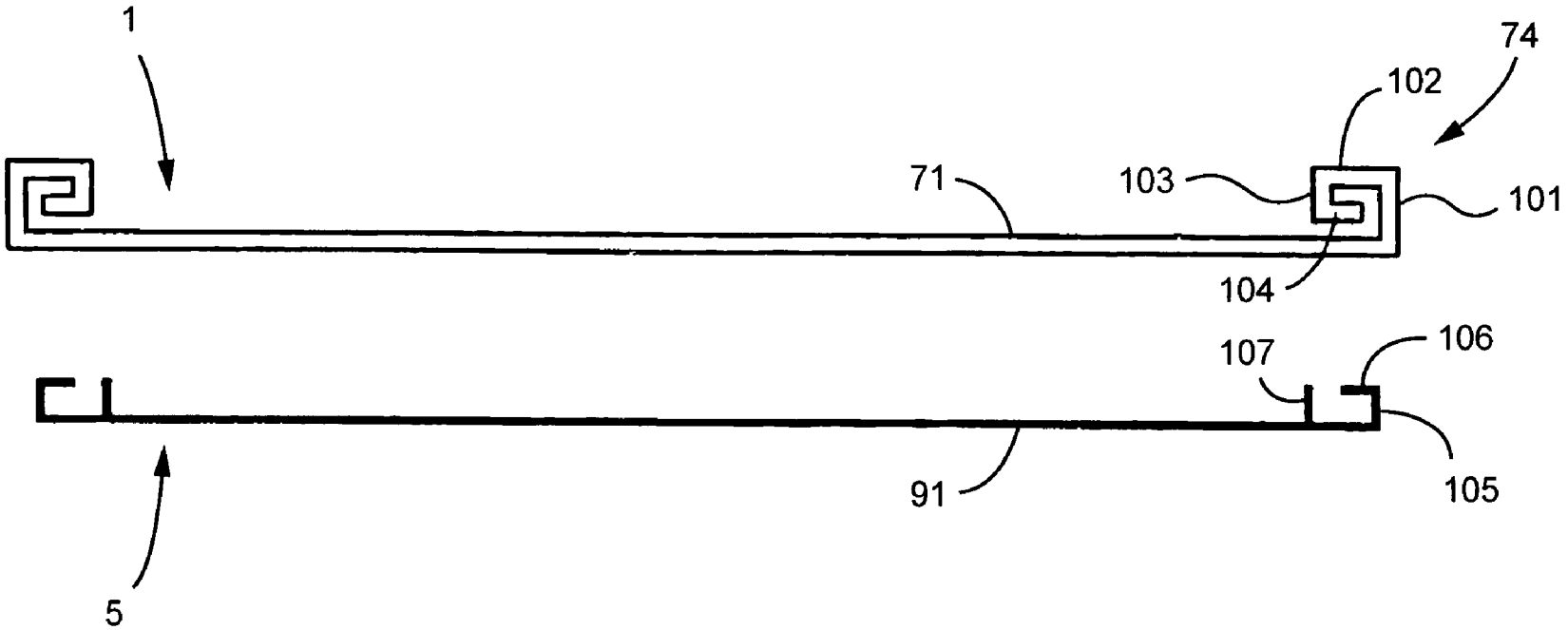
FIG. 11 illustrates sectional views of the carrier and lid shown in FIGS. 7 and 9.

FIG. 11 shows the carrier 1 and the lid 5 in section (ignoring the apertures that may be provided in and between the flaps 73). Each channel 74 comprises (as shown only for the right-hand channel in FIG. 11) an outer side wall 101, a top wall parallel to the base 71, an inner side wall 102 and a lateral flange 104 which extends from the bottom of the inner side wall back into the channel, leaving a gap between itself and the base 71. Except for this gap the channel 74 is a closed section. The plate 91 of the lid 5 has an outer side wall 105 at its lateral extremity. This side wall has an inwardly extending flange 106. The wall 105 and the flange 106 match and interlock with the inner space defined by the walls 101 to 105 and the flange 104 of the channel 74, the flange 106 engaging the flange 104 in the vertical direction to resist separation of the lid and carrier at their side margins. The base 91 also has an inner upstanding wall 106 which extends upward to engage the inner side of the inner wall 103 of the channel 74. It will be seen that the base of the lid fits into the gap to close the channel 74.

Figure 12:
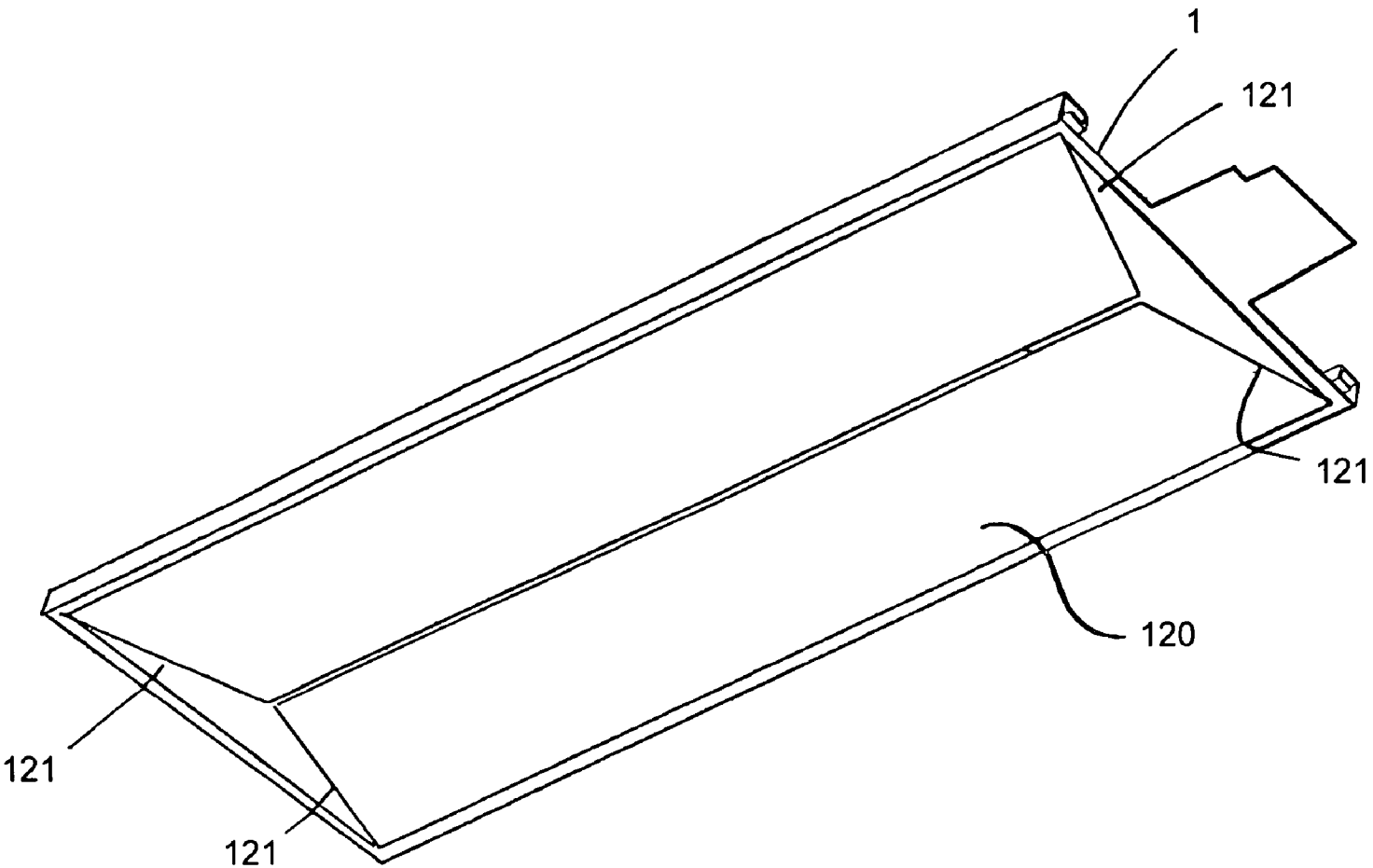
FIG. 12 is a perspective view from below of a carrier having a bag for bank notes attached to it.
Figure 13:
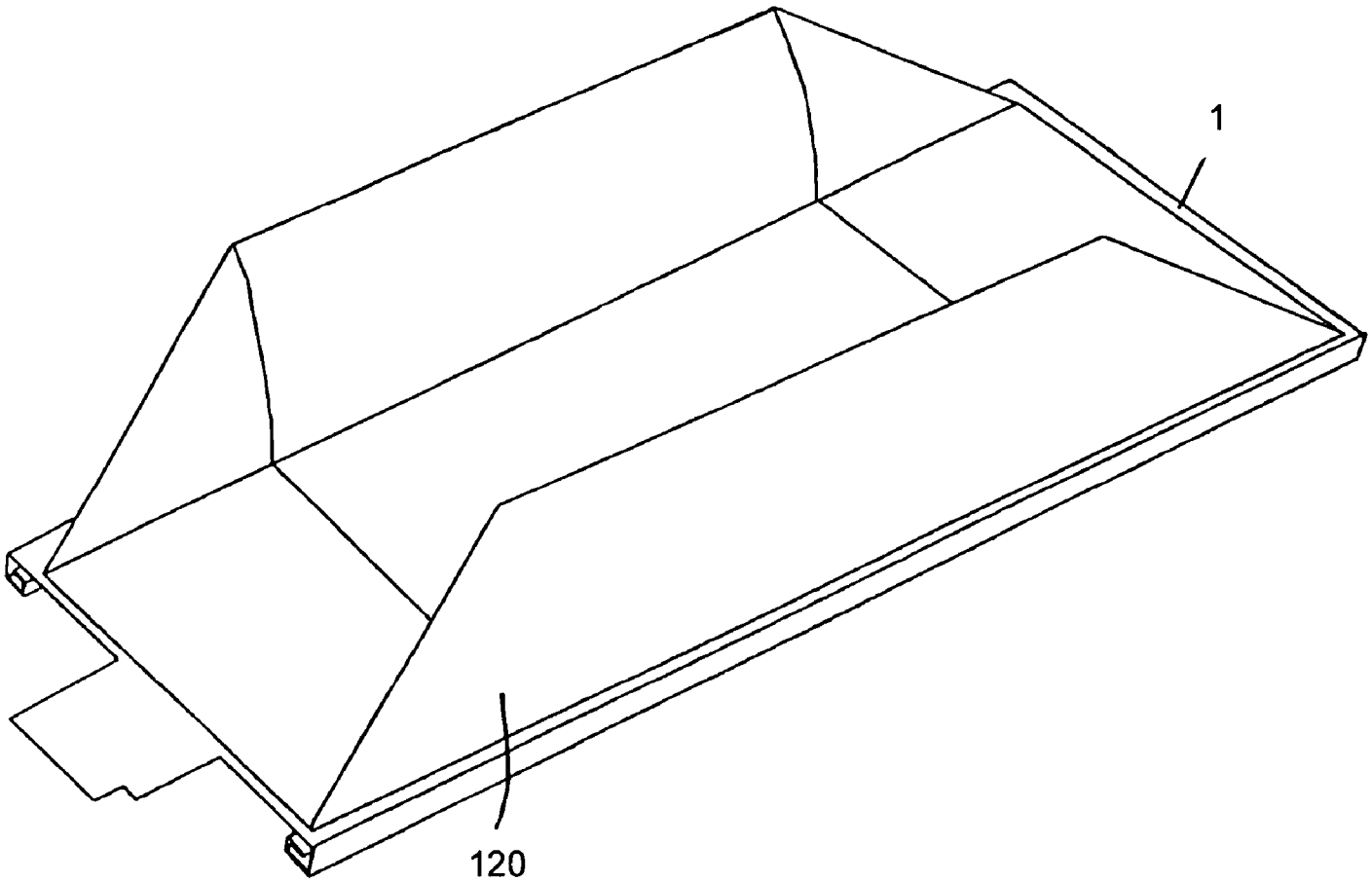
FIG. 13 is another view of the carrier and bag shown in FIG. 12.
Figure 14:
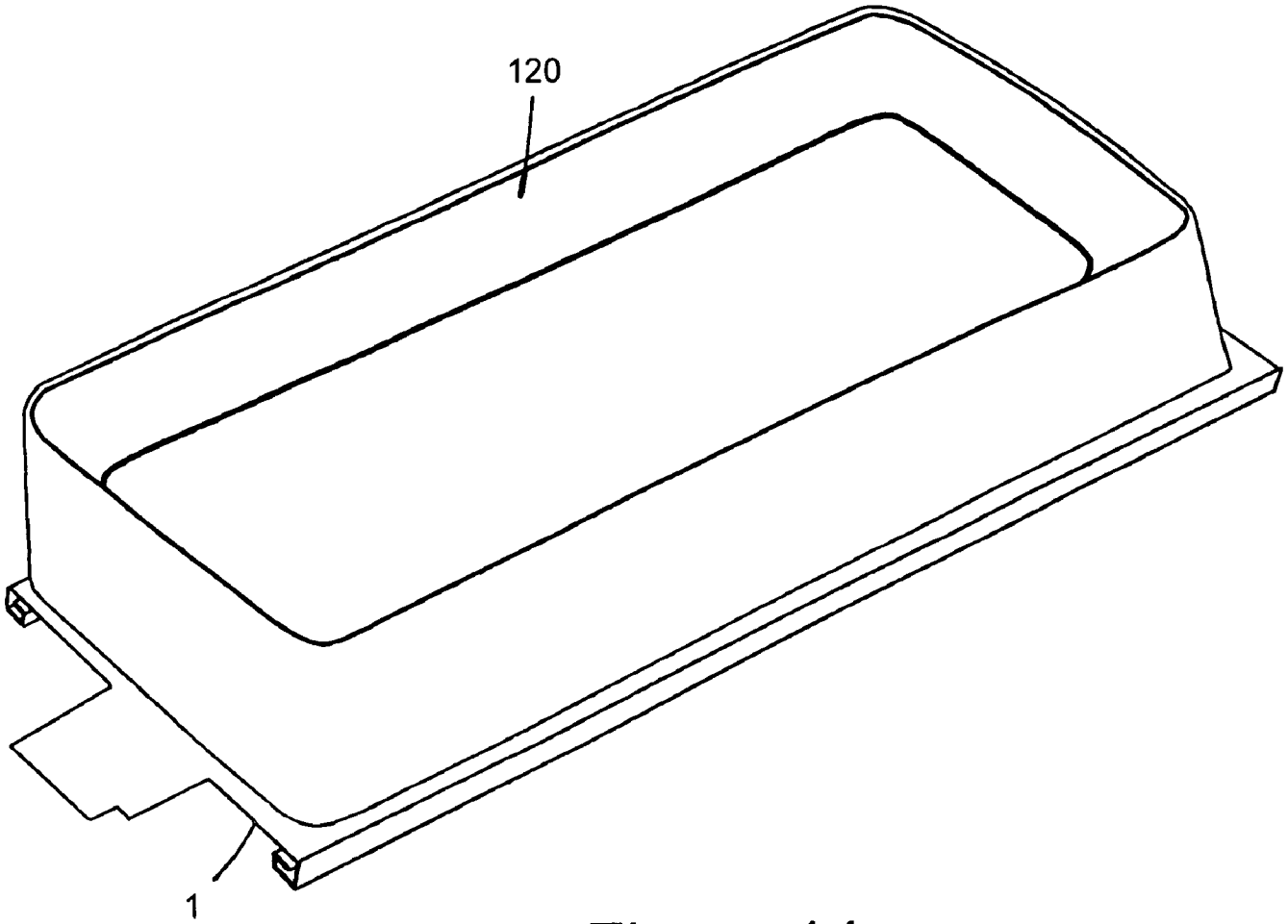
FIG. 14 is a further view of the carrier and bag shown in FIG. 12.

FIGS. 12 to 14 illustrate the carrier 1 and an attached bag 120 which is intended for use with a mechanism that includes a spring loaded platform below the bag. The bag 120 has a rectangular mouth secured to the margins of and below the carrier 1 and four corner pleats 121 which allow the bag to fold flat as shown in FIG. 12. FIG. 13 shows the bag partially expanded and FIG. 14 shows the bag fully expanded, at which time the enclosed bank notes will fill the bag and be held under the flaps in the carrier 1. The use of such a bag in conjunction with a sprung supporting platform renders the use of an elasticated bag unnecessary.

Other formations of the bag 120 may be adopted, such that the bag can expand from a folded, flat configuration to a full state below the carrier.

What is claimed is:

1. A bank note apparatus for the storage and transport of bank notes, said apparatus comprising:

a carrier and a lid, the carrier being adapted to receive the bank notes and having side portions into which the lid slides in a first plane to prevent access to the bank notes in the carrier, the side portions of the carrier engaging with side portions of the lid, and wherein said side portions provide resistance to or permanent indication of flexure or relative separation of the lid and carrier in a direction normal to said first plane;

said carrier comprises a base and said side portions each comprise a channel having a substantially closed section and said side portions of said lid each comprise an engagement portion extending within said channel; and each channel comprises an outer side wall, a top wall, an inner side wall depending from the top wall and a lateral flange extending from a bottom of the inner side wall and spaced from said base and said engagement portion extends within said channel for accommodation between said top wall and said lateral flange.

2. The bank note apparatus of claim 1 in which said lid comprises at a forward end a tongue which has serrate parts facing in said direction and which engages corresponding parts of said carrier to prevent withdrawal of said lid from said carrier.

3. The bank note apparatus of claim 2 in which said tongue enters and closes off a box section disposed on said carrier.

4. The bank note apparatus of claim 1 in which said carrier and said lid are formed from plastics material.

* * * * *